US012018418B2

(12) United States Patent
Chang

(10) Patent No.: US 12,018,418 B2
(45) Date of Patent: Jun. 25, 2024

(54) FEEDING DEVICE OF INDUSTRIAL SEWING MACHINE

(71) Applicant: EMERY IMPEX CORP., Taipei (TW)

(72) Inventor: Chin-Pao Chang, Taoyuan (TW)

(73) Assignee: EMERY IMPEX CORP., Taipei (TW)

( * ) Notice: Subject to any disclaimer, the term of this patent is extended or adjusted under 35 U.S.C. 154(b) by 142 days.

(21) Appl. No.: 17/965,461

(22) Filed: Oct. 13, 2022

(65) Prior Publication Data

US 2024/0125026 A1 Apr. 18, 2024

(51) Int. Cl.
*D05B 27/02* (2006.01)
*D05B 27/24* (2006.01)

(52) U.S. Cl.
CPC ..... *D05B 27/24* (2013.01); *D05B 27/02* (2013.01); *D10B 2505/00* (2013.01)

(58) Field of Classification Search
CPC ..... D05B 27/02; D05B 27/00; D05B 27/08; D05B 27/24
See application file for complete search history.

(56) References Cited

U.S. PATENT DOCUMENTS 3,467,039 A * 9/1969 Visaggio ..... D05B 27/02 112/303
4,226,199 A * 10/1980 Adams ..... D05B 21/002 112/323
4,584,955 A * 4/1986 Sano ..... D05B 27/22 112/446
4,624,202 A * 11/1986 Alberti ..... D05B 27/08 112/323
4,714,040 A * 12/1987 Kasuga ..... D05B 27/02 112/323
4,756,263 A * 7/1988 Sano ..... D05B 27/02 112/315
4,958,580 A * 9/1990 Asaba ..... D05B 27/02 112/323
2017/0121878 A1* 5/2017 Koike ..... D05B 27/08

* cited by examiner

*Primary Examiner* — Nathan E Durham
(74) *Attorney, Agent, or Firm* — RABIN & BERDO, P.C.

(57) ABSTRACT

A feeding device of an industrial sewing machine comprises a shell base, a main connecting rack having a first bar portion and a second bar portion, a terminal driven rack mounted at the first bar portion and the second bar portion, a first driven rack, a raising-driven mechanism and a driving shaft. The first driven rack is mounted at the first bar portion and connected to the shell base, and has a first sliding recess. The raising-driven mechanism has a second driven rack mounted at the second bar portion and having a second sliding recess. A raising-connecting rod is mounted at the second driven rack and the terminal driven rack. The driving shaft has a first crank mounted through the first sliding recess and a second crank mounted through the second sliding recess. The feeding device has a compact volume to facilitate ease in maintenance.

9 Claims, 13 Drawing Sheets

FEEDING DEVICE OF INDUSTRIAL SEWING MACHINE

BACKGROUND OF THE INVENTION

1. Field of the Invention

The present invention relates to a part of a sewing machine.

2. Description of the Prior Arts

A feeding device of a sewing machine is a device which linearly drives fabric to move along a particular direction while a needle of the sewing machine moves up and down to process flat sewing. That is, the feeding device is a device controlling feeding of the fabric.

The feeding device is mounted under a needle plate of the sewing machine, and comprises a driving shaft, a feed dogs plate, and a transmission mechanism mounted between the driving shaft and the feed dogs plate. While processing flat sewing, the driving shaft is rotated by a motor of the sewing machine, and the transmission mechanism transmits rotations of the driving shaft into both up-and-down movements and horizontal movements of the feed dogs plate. During sewing, the feed dogs plate is sequentially moved upward from an original position, protruding through the needle plate to abut against fabric on the needle plate, then is moved along a horizontal feeding direction to drive the fabric to move for a particular distance. And then, the feed dogs plate is moved downward to be under the needle plate, and finally is moved along a direction opposite to the horizontal feeding direction and back to the original position. The feed dogs plate will be moved with the abovementioned motions repeatedly to drive the fabric to move along the horizontal feeding direction continuously.

However, the traditional feeding device has the following shortcomings:

First, the transmission mechanism has a large size, and elements of the transmission mechanism are separate in different parts of the sewing machine, which leads to difficulty in maintenance when malfunction occurs.

Second, the sewing machine with the feeding device can only process flat sewing, and cannot process embossing sewing. A user needs to buy an extra sewing machine for embossing sewing, increasing the expense. The embossing sewing is that the sewing machine itself would not drive the fabric to move linearly, but feeding movements of the fabric are controlled by the user, therefore various non-linear sewing can be processed.

Thus, an industrial sewing machine with the traditional feeding device needs to be improved.

SUMMARY OF THE INVENTION

To resolve the drawback of traditional techniques, the present invention provides a feeding device of an industrial sewing machine that has a compact size to facilitate ease in maintenance.

A feeding device of an industrial sewing machine of the present invention comprises a shell base, a main connecting rack, a terminal driven rack, a feeding-driven mechanism, a raising-driven mechanism and a driving shaft. The main connecting rack is pivotally connected to the shell base, and has a rotating axis, a first bar portion and a second bar portion. The first bar portion and the second bar portion both extend along a radial direction of the rotating axis of the main connecting rack. One end of the terminal driven rack is pivotally connected to an outer end of the first bar portion, and the other end of the terminal driven rack is pivotally connected to an outer end of the second bar portion. The terminal driven rack has a feed dogs plate. The feeding-driven mechanism is connected to the first bar portion of the main connecting rack and the shell base, and has a first driven rack. The first driven rack has a first connecting end and a first recess end. The first connecting end is pivotally connected to the first bar portion of the main connecting rack. The first recess end is connected to the shell base, and has a first sliding recess. The raising-driven mechanism is connected to the second bar portion of the main connecting rack and the terminal driven rack, and has a second driven rack and a raising-connecting rod. The second driven rack has a second connecting end and a second recess end. The second connecting end is pivotally connected to the second bar portion of the main connecting rack. The second recess end has a second sliding recess. One end of the raising-connecting rod is pivotally connected to the second recess end of the second driven rack, and another end of the raising-connecting rod is pivotally connected to the terminal driven rack. The driving shaft is rotatably mounted to the shell base, and has a first crank and a second crank. The first crank is mounted through and abuts against the first sliding recess of the first driven rack of the feeding-driven mechanism. The second crank is mounted through and abuts against the second sliding recess of the second driven rack of the raising-driven mechanism.

The advantage of the feeding device of an industrial sewing machine is that the driving shaft has the first crank and the second crank. When the driving shaft is rotated, the first crank drives the feed dogs plate through the feeding-driven mechanism and the terminal driven rack, making the feed dogs plate generate a mostly horizontal reciprocating motion. The second crank drives the feed dogs plate through the raising-driven mechanism and the terminal driven rack, making the feed dogs plate generate a mostly up-and-down reciprocating motion. Therefore a volume of the feeding device is reduced, and elements of the feeding device are mostly put under a needle plate of a sewing machine for easier maintenance.

DETAILED DESCRIPTION OF THE PREFERRED EMBODIMENTS

Figure 1:
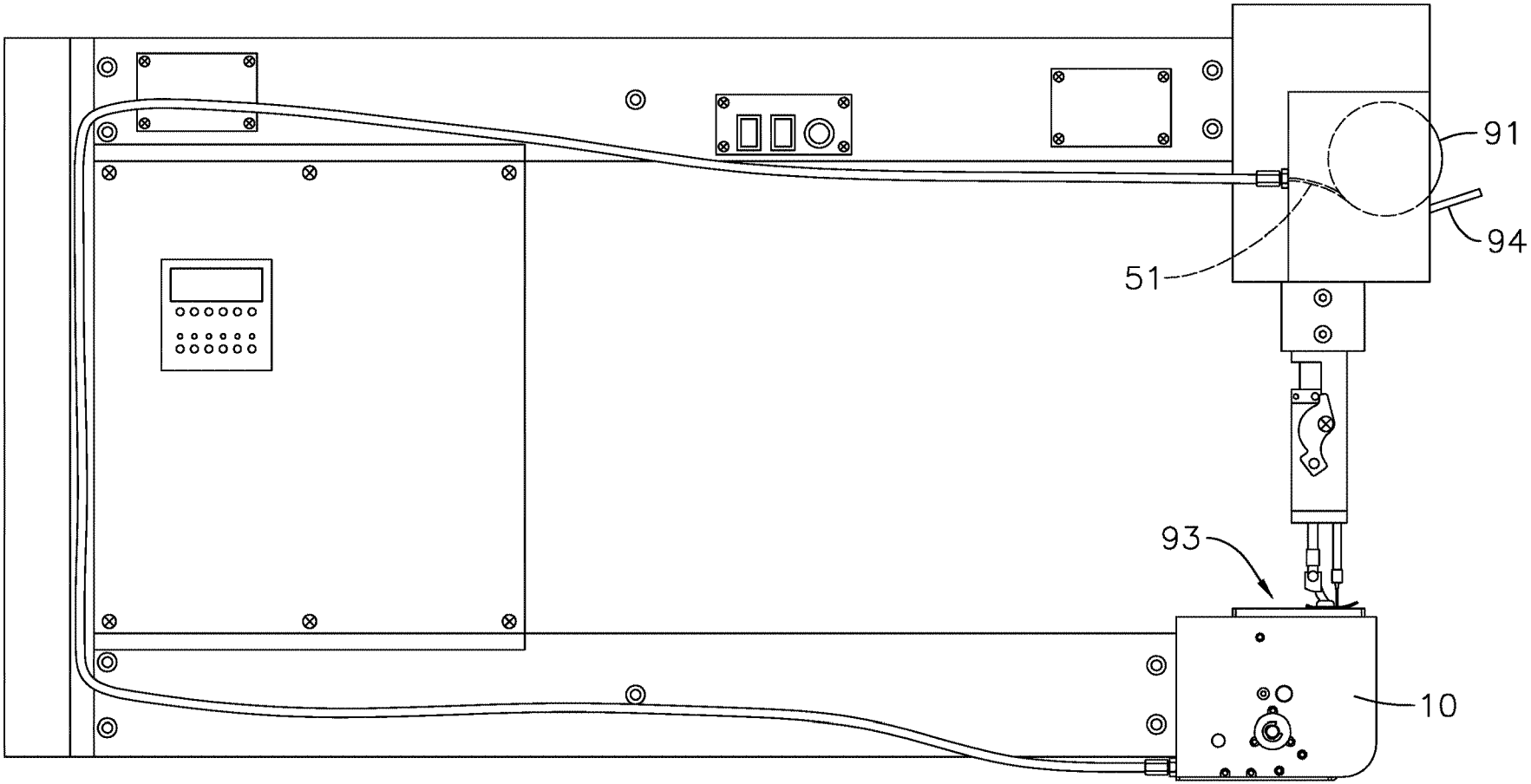
FIG. 1 is a side view of an embodiment of a feeding device in accordance with the present invention, mounted at a sewing machine.
Figure 2:
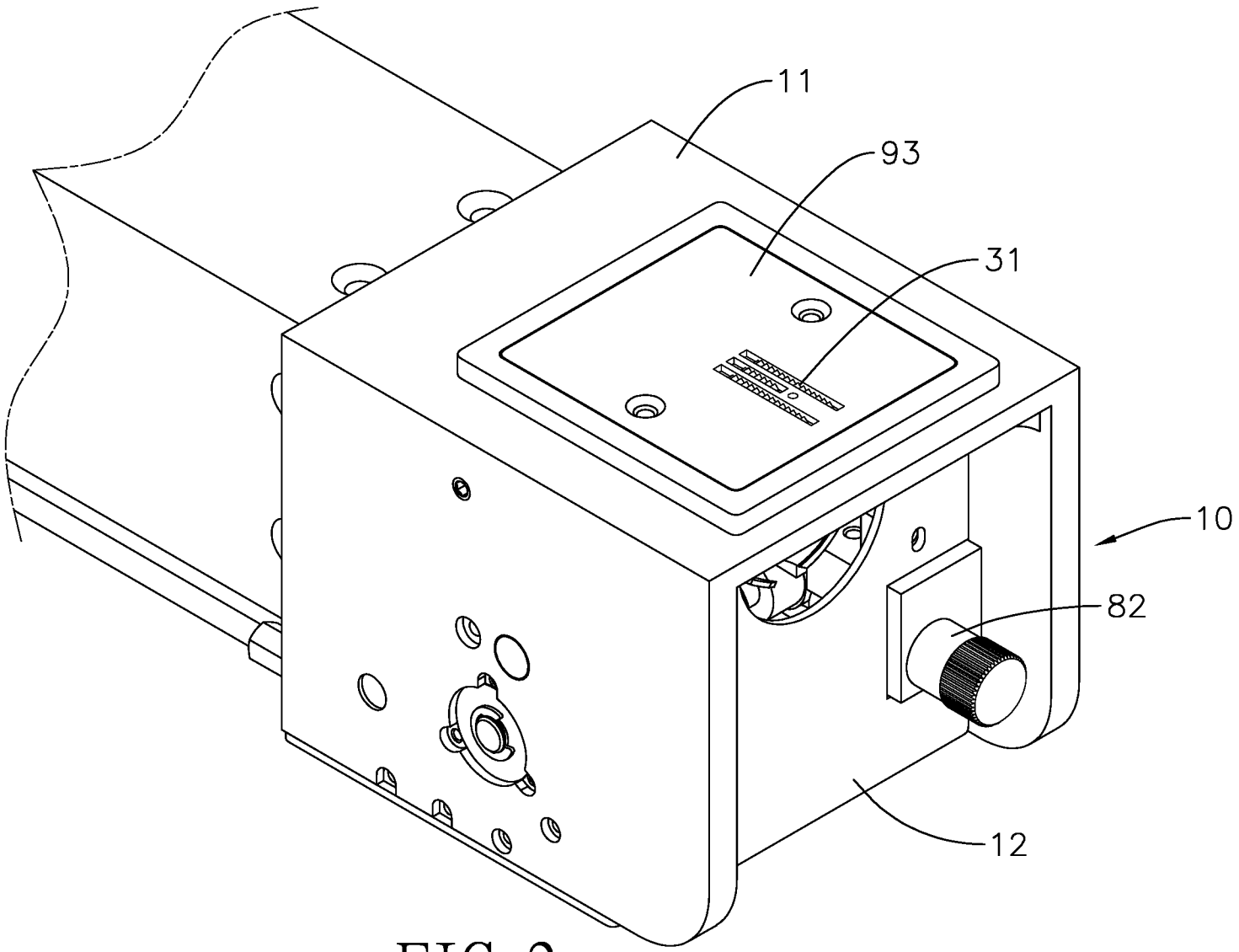
FIG. 2 is a perspective view of the feeding device in FIG. 1.
Figure 3:
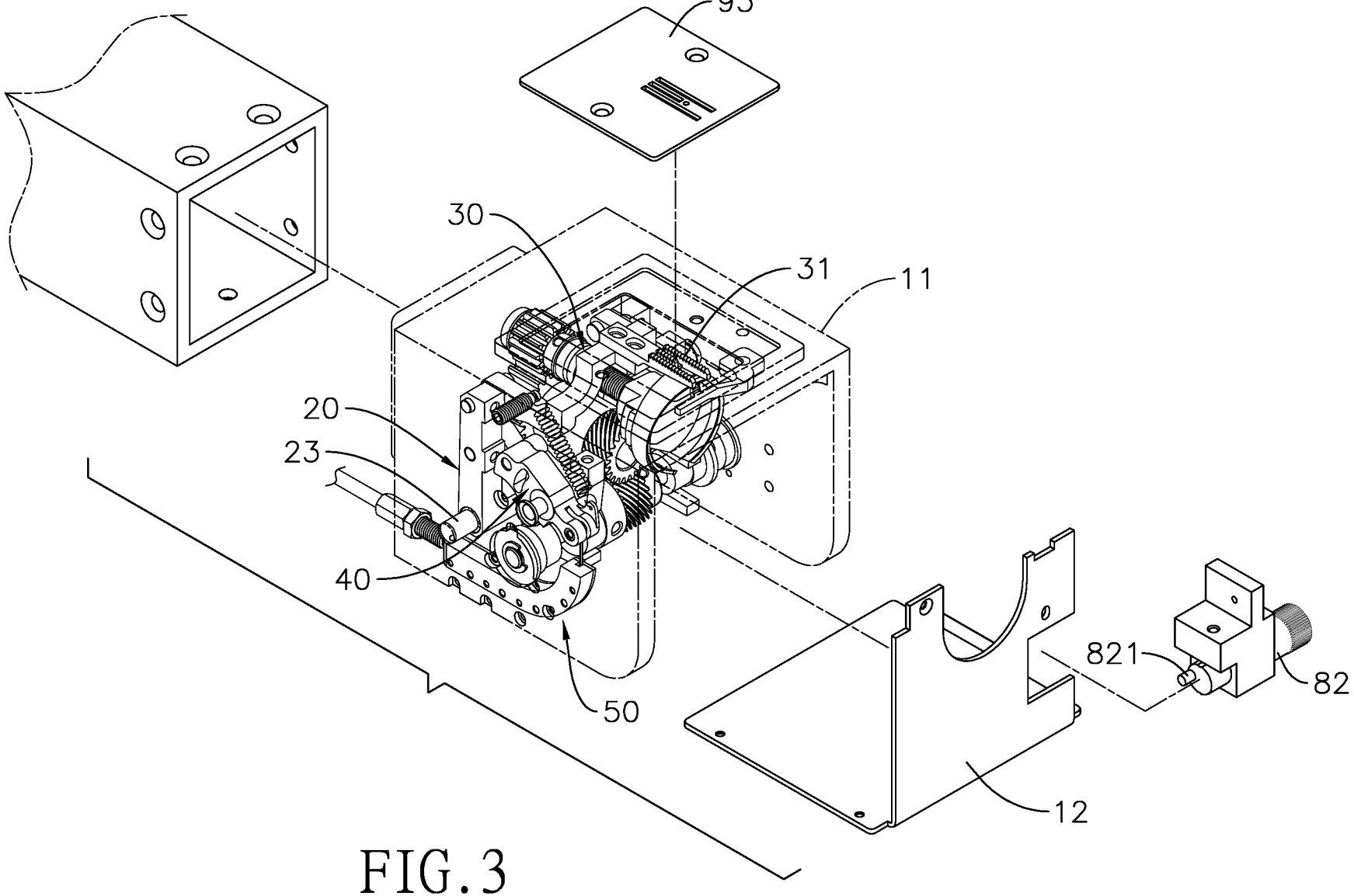
FIG. 3 is an exploded view of the feeding device in FIG. 1.
Figure 4:
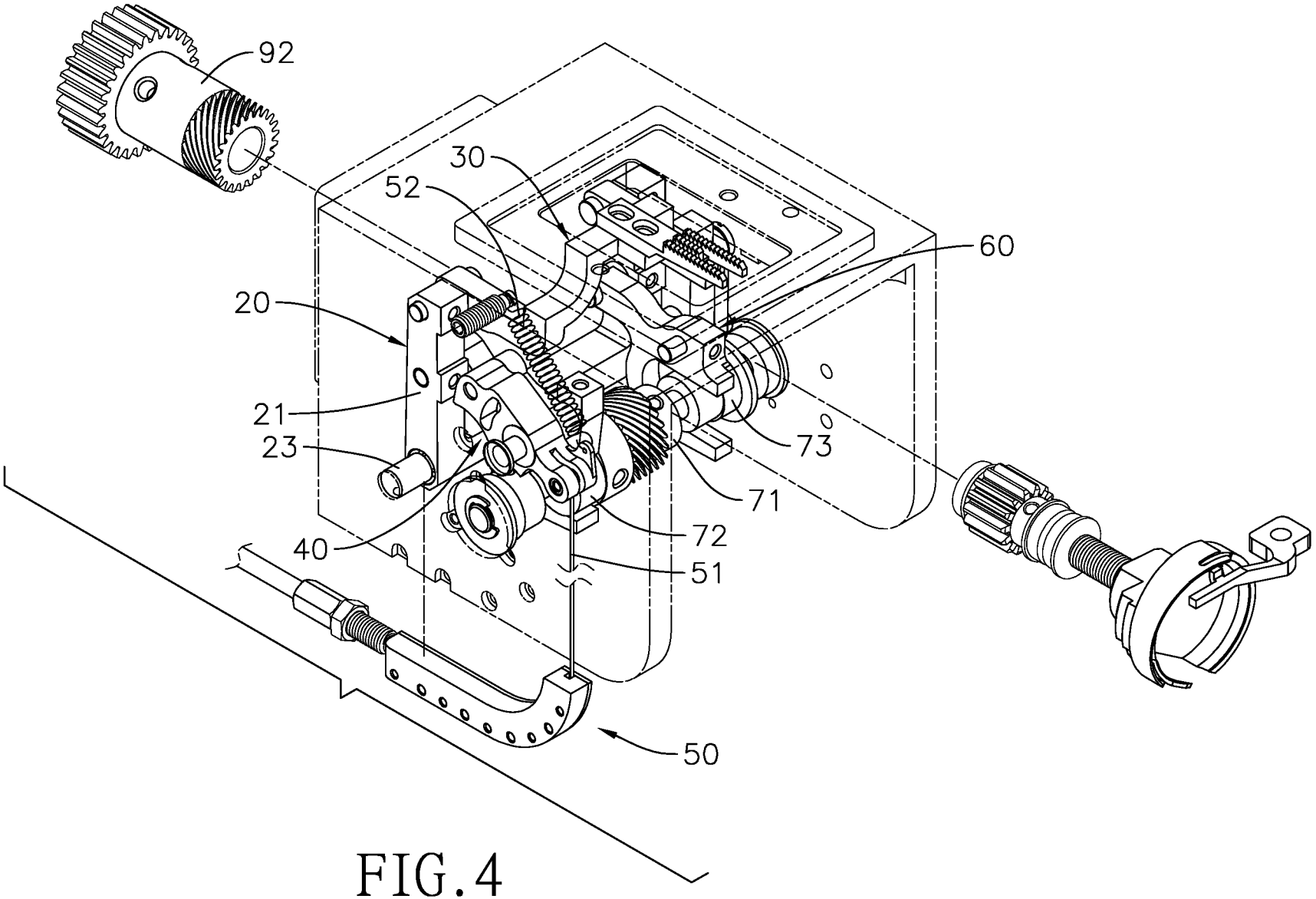
FIG. 4 is another exploded view of the feeding device in FIG. 1.

FIGS. 1 to 4 and 10 show an embodiment of a feeding device of an industrial sewing machine in accordance with the present invention. The feeding device of an industrial sewing machine comprises a shell base 10, a main connecting rack 20, a terminal driven rack 30, a feeding-driven mechanism 40, a raising-driven mechanism 60 and a driving shaft 71. In the present embodiment, the present invention further comprises a feeding-controlling mechanism 50 and a raising-controlling mechanism 80 (shown in FIG. 10).

The shell base 10 is preferably a hollow cubic body assembled by an upper shell 11 and a bottom shell 12. A needle plate 93 of a sewing machine is mounted at an upper opening of the upper shell 11. Preferably, elements of the feeding device are all or mostly mounted inside the shell base 10.

Figure 5:
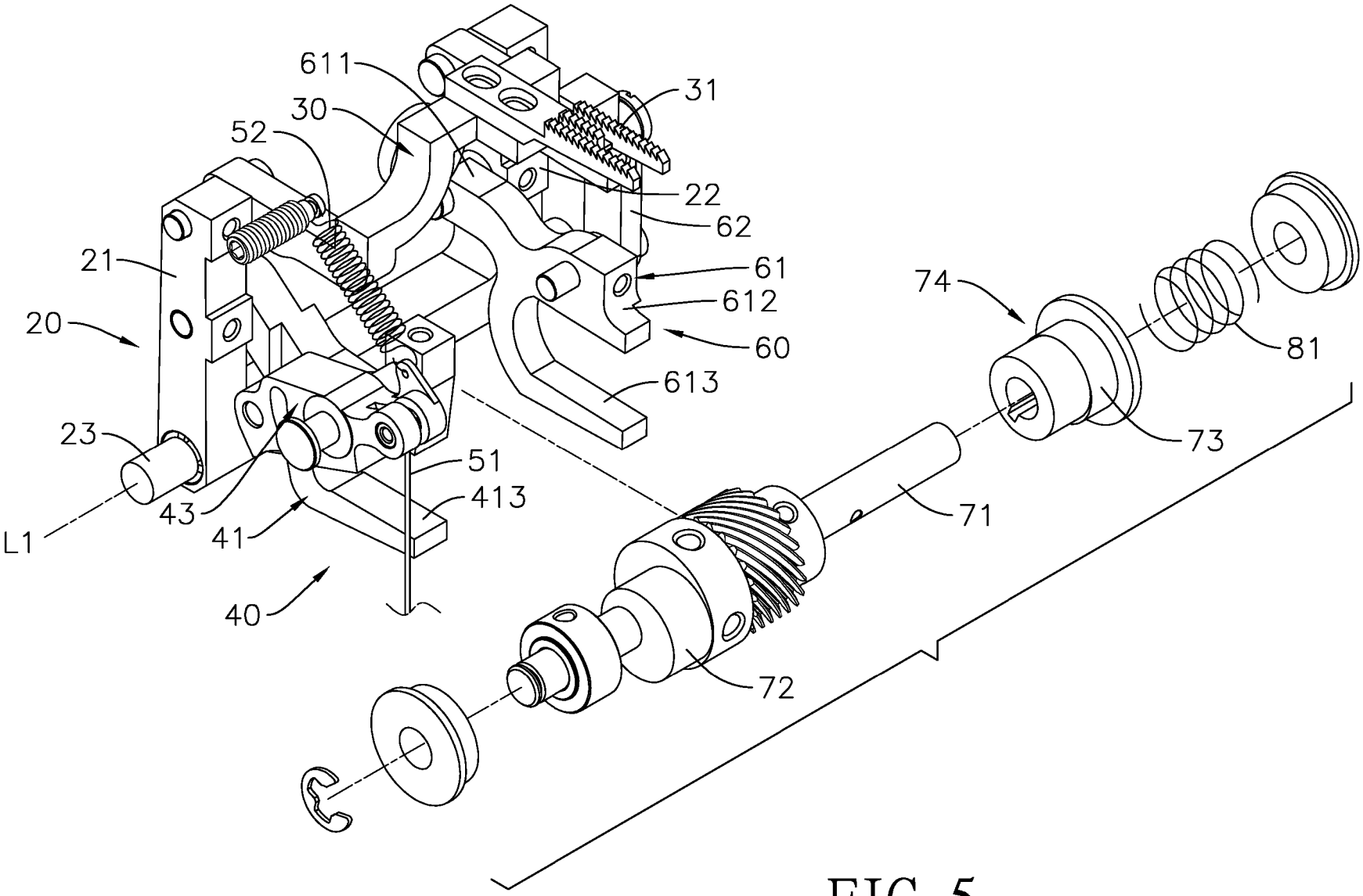
FIG. 5 is a partial exploded view of the feeding device in FIG. 1.
Figure 6:
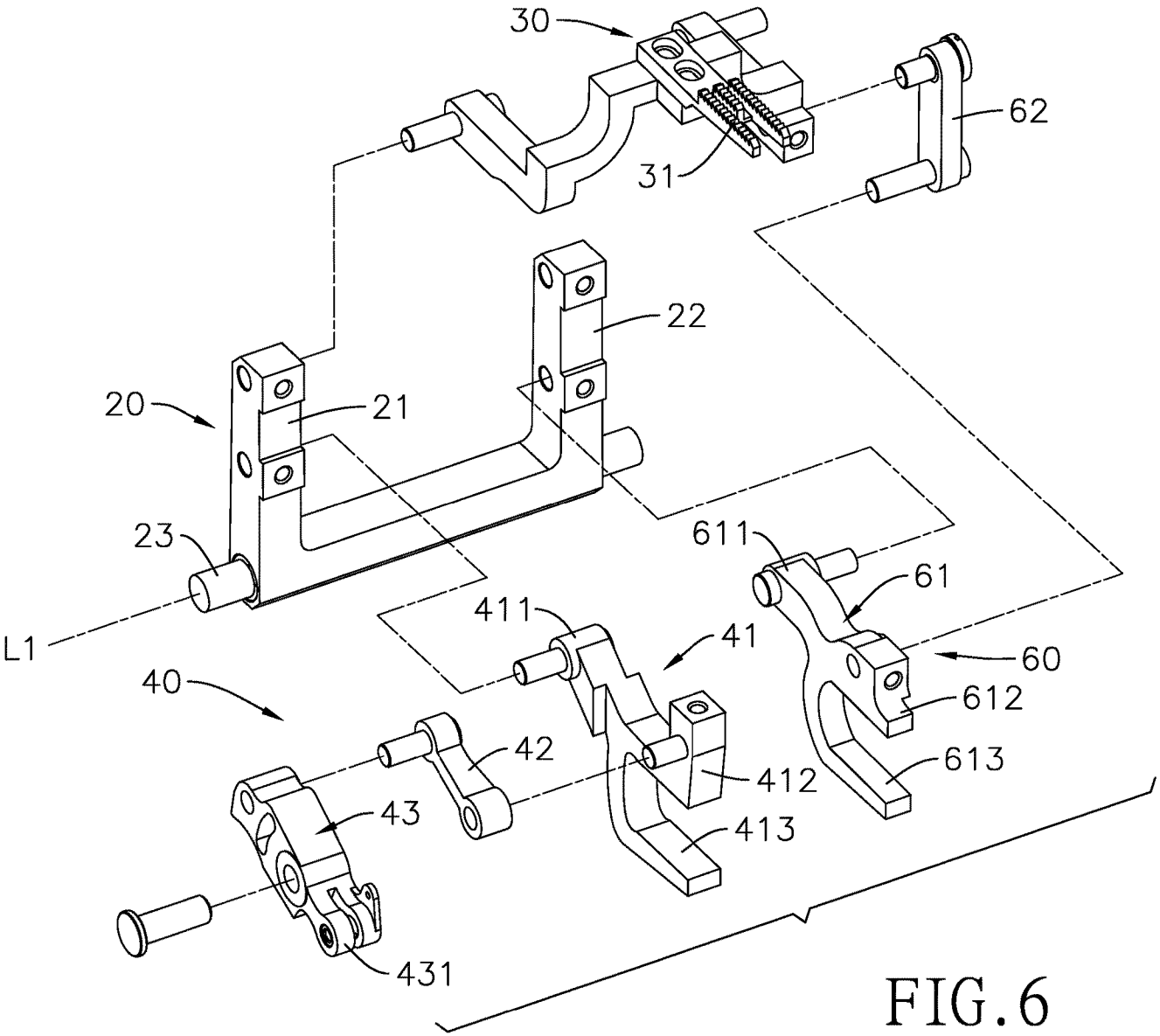
FIG. 6 is another partial exploded view of the feeding device in FIG. 1.
Figure 7:
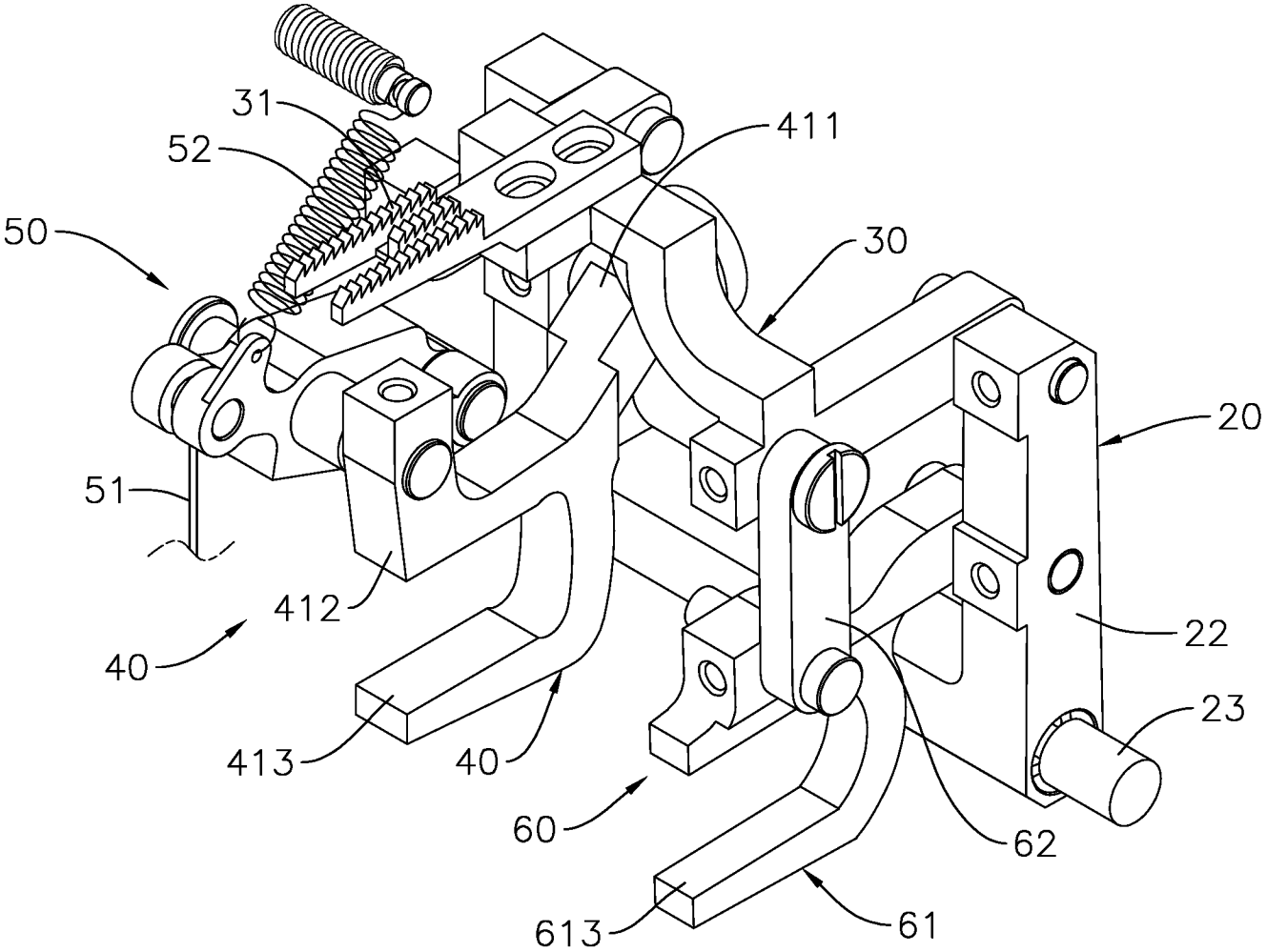
FIG. 7 is a partial perspective view of the feeding device in FIG. 1.

With reference to FIGS. 5 to 7, the main connecting rack 20 is pivotally mounted inside the shell base 10, and has a rotating axis L1, a first bar portion 21 and a second bar portion 22. The first bar portion 21 and the second bar portion 22 both extend along a radial direction of the rotating axis L1 of the main connecting rack 20. Specifically, the main connecting rack 20 is approximately a U-shaped rack, and the first bar portion 21 and the second bar portion 22 are straight bars parallel to each other. The main connecting rack 20 is mounted inside the shell base 10 by a first rotating bar 23, and is capable of swinging inside the shell base 10.

For the terminal driven rack 30, one end of the terminal driven rack 30 is pivotally connected to an outer end of the first bar portion 21 of the main connecting rack 20, and the other end of the terminal driven rack 30 is pivotally connected to an outer end of the second bar portion 22 of the main connecting rack 20. Therefore, the terminal driven rack 30 is connected to the main connecting rack 20 and is rotatable relative to the main connecting rack 20. A rotational axis of the terminal driven rack 30 pivoted relative to the main connecting rack 20 is preferably parallel to the rotating axis L1 of the main connecting rack 20 relative to the shell base 10. The terminal driven rack 30 has a feed dogs plate 31.

The feeding-driven mechanism 40 is connected to the first bar portion 21 of the main connecting rack 20 and the shell base 10, has a first driven rack 41, and preferably further has a first feeding-connecting rod 42 and a second feeding-connecting rod 43. The first driven rack 41 has a first connecting end 411 and a first recess end 412. The first connecting end 411 is pivotally connected to the first bar portion 21 of the main connecting rack 20, and therefore the first driven rack 41 can swing in up-and-down motions relative to the main connecting rack 20. The first recess end 412 is connected to the shell base 10 and has a first sliding recess 413.

In the present embodiment, the first recess end 412 of the first driven rack 41 is not directly connected to the shell base 10, but is connected to the shell base 10 by the first feeding-connecting rod 42 and the second feeding-connecting rod 43. To be specific, the first feeding-connecting rod 42 has a first rod-connecting end and a recess-connecting end, which is pivotally connected to the first recess end 412 of the first driven rack 41. The second feeding-connecting rod 43 has a second rod-connecting end pivotally connected to the first rod-connecting end of the first feeding-connecting rod 42, and has a base-connecting end pivotally connected to the shell base 10. That is, two ends of the second feeding-connecting rod 43 are respectively connected to the first feeding-connecting rod 42 and the shell base 10. The second feeding-connecting rod 43 has a cable-connecting portion 431 protruding from the base-connecting end.

The feeding-controlling mechanism 50 is connected to the second feeding-connecting rod 43 of the feeding-driven mechanism 40, and controls an angle of the second feeding-connecting rod 43 relative to the shell base 10. By that, the second feeding-connecting rod 43 changes a position of the first rod-connecting end of the first feeding-connecting rod 42 in space, then by the first driven rack 41 and the main connecting rack 20, the first feeding-connecting rod 42 changes moving trials of the terminal driven rack 30 and the feed dogs plate 31. Therefore a horizontal moving stroke of the feed dogs plate 31 and a circling direction of the feed dogs plate 31 are altered to control the feeding device to feed or reverse fabrics, and to control a feeding stroke and a reversing stroke.

With reference to FIGS. 1, 3, 8 and 9, specifically, the feeding-controlling mechanism 50 has a cable 51 and a feeding-controlling resilient element 52. The cable 51 is preferably a steel cable. Two ends of the cable 51 are respectively connected to the cable-connecting portion 431 of the second feeding-connecting rod 43 and a pitch-regulating disc 91 (shown in FIG. 1). When a user turns the pitch-regulating disc 91, the cable 51 will drag the cable-connecting portion 431, making the second feeding-connecting rod 43 pivot along a fabric-feeding direction D1, thereby changing the angle of the second feeding-connecting rod 43 relative to the shell base 10.

The feeding-controlling resilient element 52 is preferably an extension spring, and is configured to drive the second feeding-connecting rod 43 to pivot along a direction opposite to the fabric-feeding direction D1 (shown in FIGS. 8 and 9), thus keeping a tension of the cable 51 and stabilizing the angle of the second feeding-connecting rod 43.

With reference to FIGS. 5 to 7, the raising-driven mechanism 60 is connected to the second bar portion 22 of the main connecting rack 20 and the terminal driven rack 30, and has a second driven rack 61 and a raising-connecting rod 62. The second driven rack 61 has a second connecting end 611 and a second recess end 612, which has a second sliding recess 613. The second connecting end 611 is pivotally connected to the second bar portion 22 of the main connecting rack 20, and therefore the second driven rack 61 can swing in up-and-down motions relative to the main connecting rack 20. One end of the raising-connecting rod 62 is pivotally connected to the second recess end 612 of the second driven rack 61, and the other end of the raising-connecting rod 62 is pivotally connected to the terminal driven rack 30. An up-and-down sway of the second driven rack 61 drives the feed dogs plate 31 to move in up-and-down motions through the raising-connecting rod 62 and the terminal driven rack 30.

The driving shaft 71 is rotatably mounted at the shell base 10, and has a first crank 72 and a second crank 73. To be specific, the driving shaft 71 has a switching sleeve 74 mounted around the driving shaft 71, and being axially movable and non-rotatable relative to the driving shaft 71. The second crank 73 protrudes from an outer circumferential surface of the switching sleeve 74. The second crank 73 and the switching sleeve 74 are formed in one-piece. The second crank 73 is configured to axially move along the driving shaft 71. The first crank 72 is fixed on the driving shaft 71 and is incapable of moving relative to the driving shaft 71.

The first crank 72 is mounted through and abuts against the first sliding recess 413 of the first driven rack 41 of the feeding-driven mechanism 40. As a result, while the driving shaft 71 rotates, the first crank 72 will directly drive the first driven rack 41 to swing in up-and-down motions, and will indirectly drive elements connected to the first driven rack 41 to generate motions.

The second crank 73 is mounted through and abuts against the second sliding recess 613 of the second driven rack 61 of the raising-driven mechanism 60. By that, while the driving shaft 71 rotates, the second crank 73 will directly drive the second driven rack 61 to swing in up-and-down motions, and will indirectly drive elements connected to the second driven rack 61 to generate motions, and the feed dogs plate 31 thus is moved in up-and-down motions. In the present embodiment, the second crank 73 is configured to selectively move away axially to detach from the second sliding recess 613, thereby significantly reducing an up-and-down moving distance of the feed dogs plate 31.

With reference to FIGS. 3 and 10 to 13, the raising-controlling mechanism 80 (shown in FIG. 10) selectively moves the switching sleeve 74 along an axial direction of the driving shaft 71, thereby moving the second crank 73 to detach from or mount through the second sliding recess 613, and the up-and-down moving distance of the feed dogs plate 31 thus is controlled. Specifically, the raising-controlling mechanism 80 has a raising-controlling resilient element 81 and a raising-operating element 82. The raising-controlling resilient element 81 is preferably a compression spring, and is configured to drive the switching sleeve 74 to move along a mounting direction D2, thereby moving the second crank 73 to mount through the second sliding recess 613.

The raising-operating element 82 is pivotally connected to the shell base 10, and can selectively drive the switching sleeve 74 to move along a direction opposite to the mounting direction D2, thereby moving the second crank 73 to detach from the second sliding recess 613. Specifically, the raising-operating element 82 is a cylinder, and an inner side, which is inside the shell base 10, of the raising-operating element 82 has an eccentric bar 821. When the raising-operating element 82 is pivoted, the eccentric bar 821 will push the switching sleeve 74 to move axially.

While the present invention operates, by using a power-inputting shaft 92 to drive the driving shaft 71 to rotate, the driving shaft 71 drives the feeding-driven mechanism 40 by the first crank 72 and drives the raising-driven mechanism 60 by the second crank 73. Therefore the feed dogs plate 31 generates a round motion comprising up-and-down motions and horizontal motions to reach a fabric-feeding movement track same as a feeding device of an industrial sewing machine nowadays.

Figure 12:
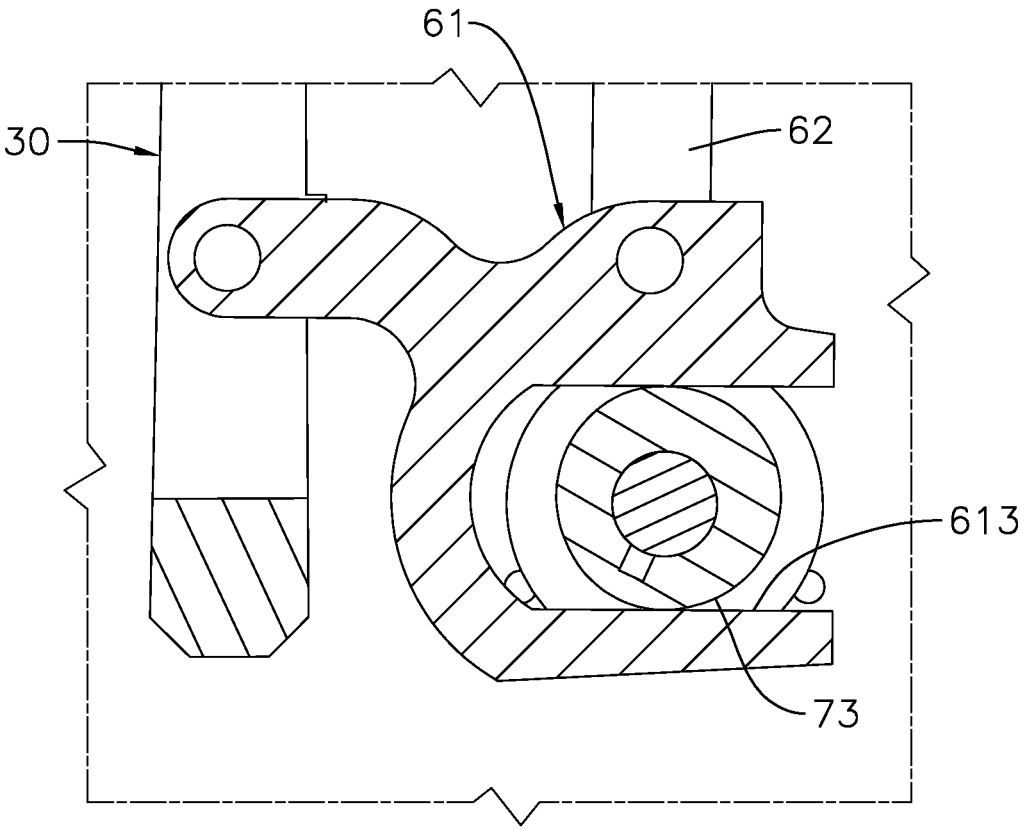
FIG. 12 is a partial sectional view across line 12-12 in FIG. 10.
Figure 13:
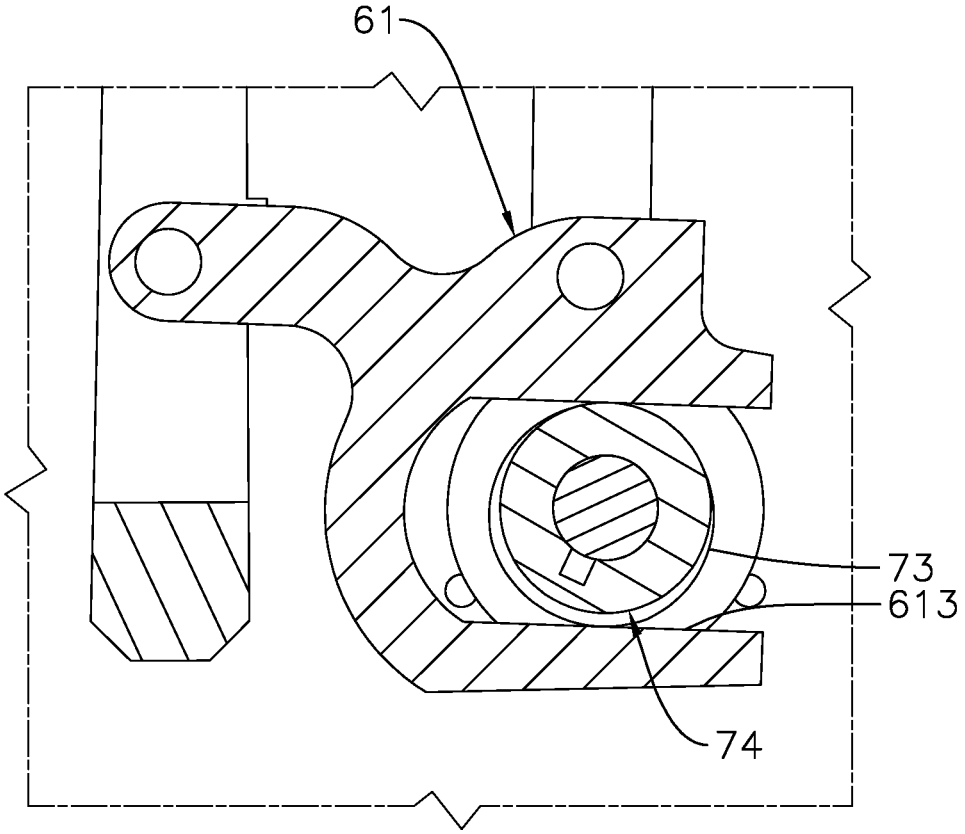
FIG. 13 is a partial sectional view across line 13-13 in FIG. 11.

With reference to FIGS. 12 and 13, if embossing sewing is required, turn the raising-operating element 82 to make the second crank 73 detach from the second sliding recess 613. At this time, the up-and-down moving distance of the feed dogs plate 31 is significantly reduced, the feed dogs plate 31 thus cannot be raised to attach the fabric, and therefore the user can move the fabric freely to proceed with embossing sewing.

Figure 8:
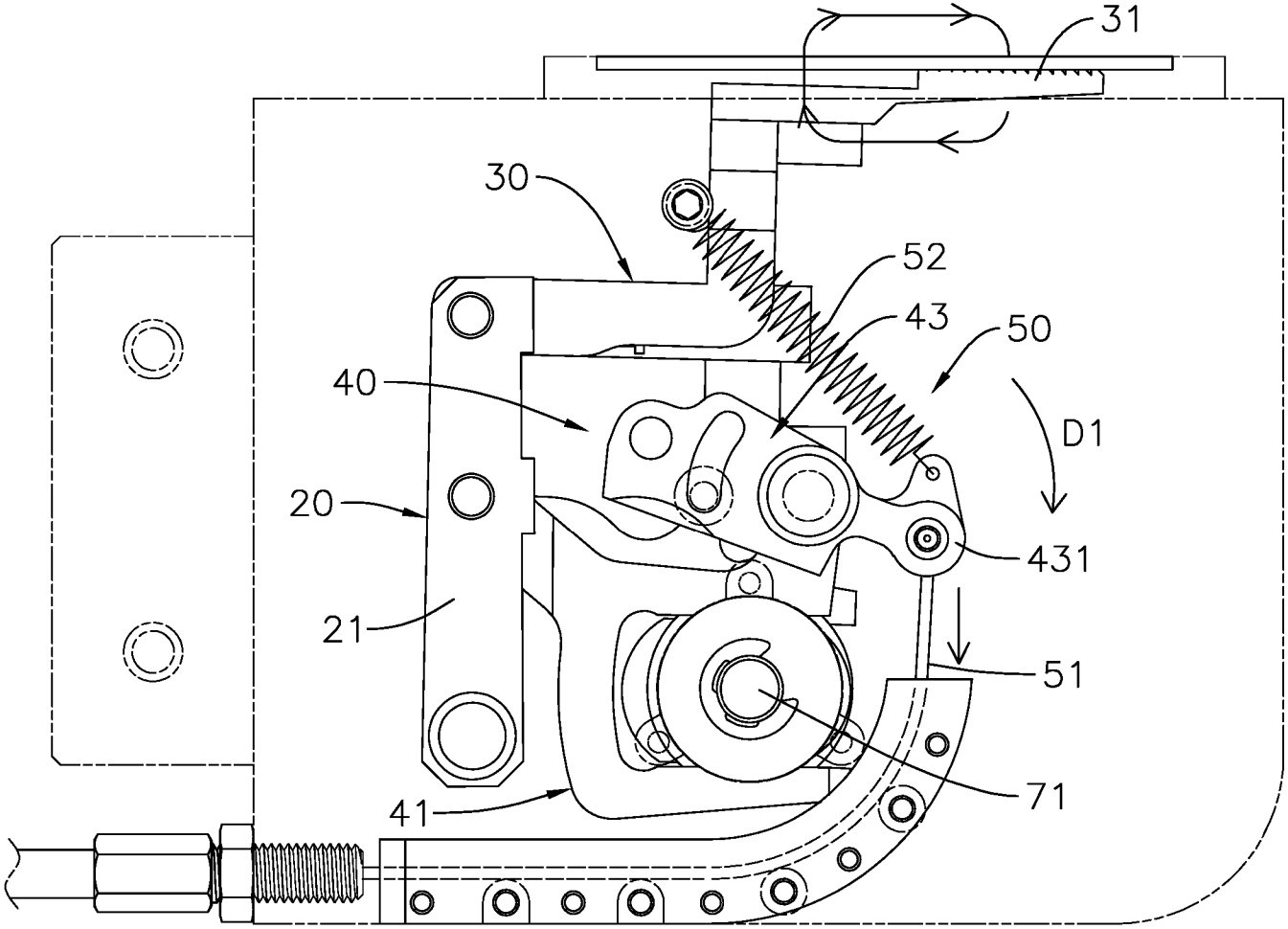
FIGS. 8 and 9 are side views of the feeding device in FIG. 1, showing changes of an angle of a second feeding-connecting rod controlled by a feeding-controlling mechanism.
Figure 9:
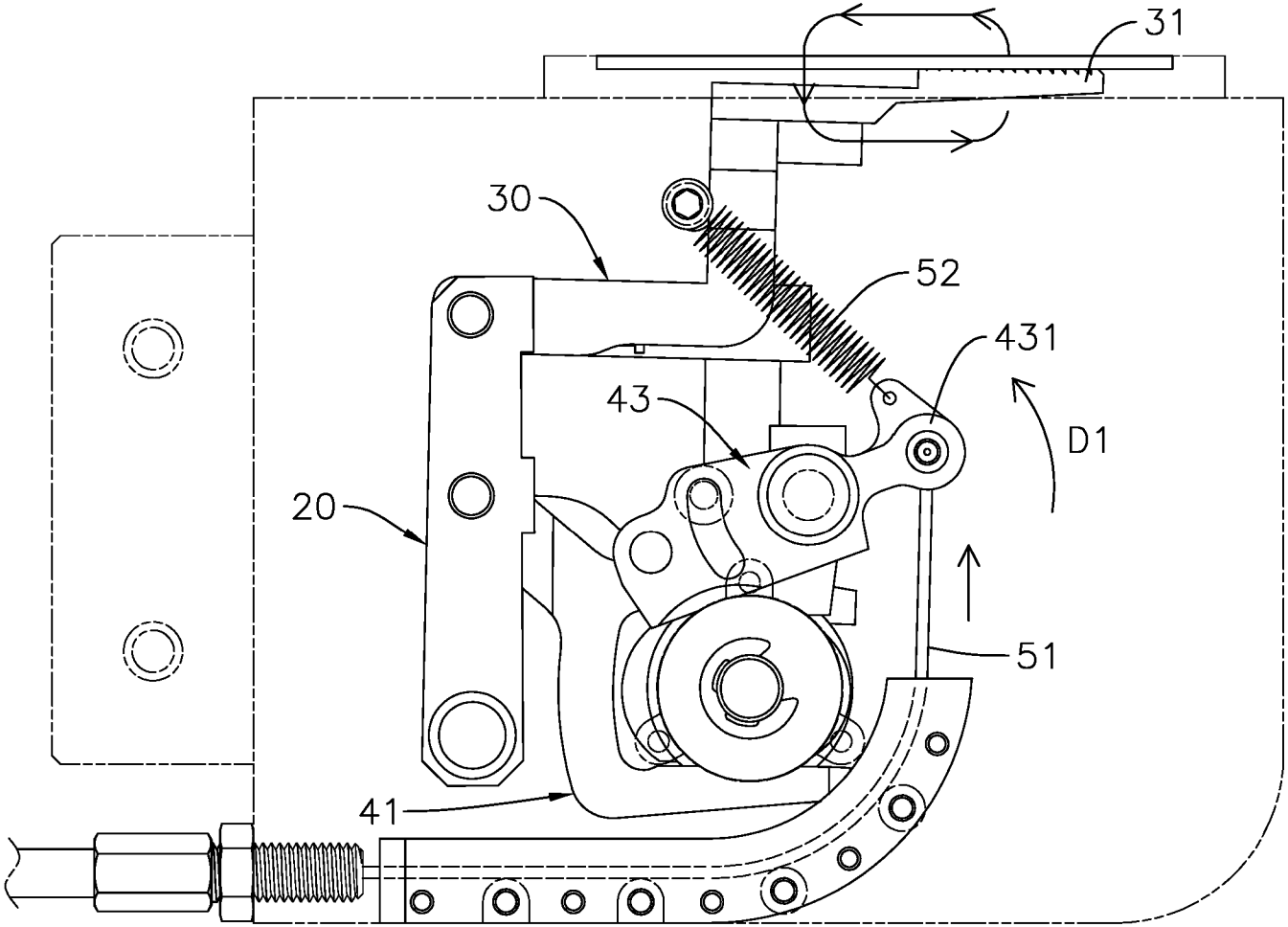
Figure 10:
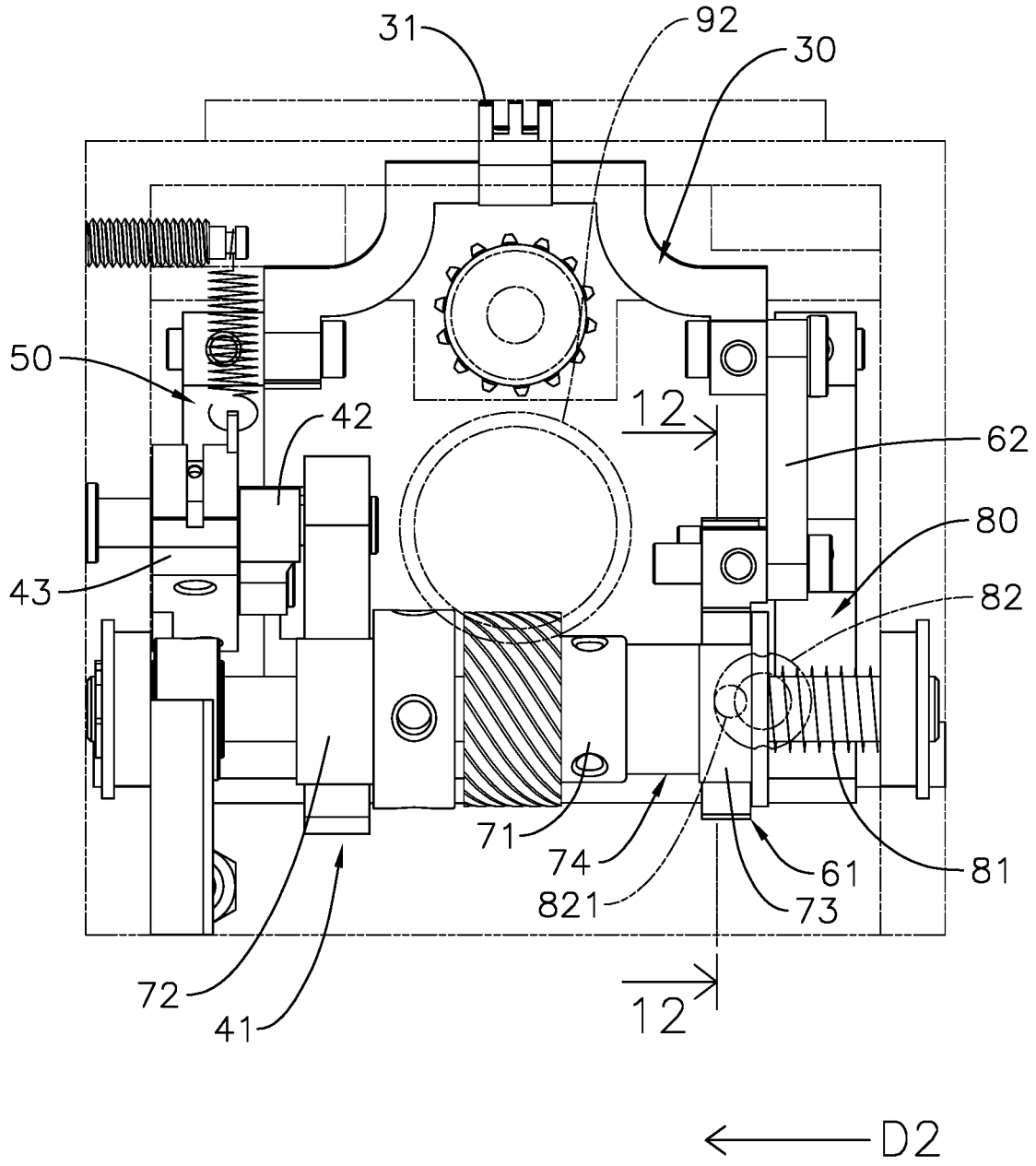
FIG. 10 is a front view of the feeding device in FIG. 1, showing a second crank mounted through a second sliding recess of a second driven rack.
Figure 11:
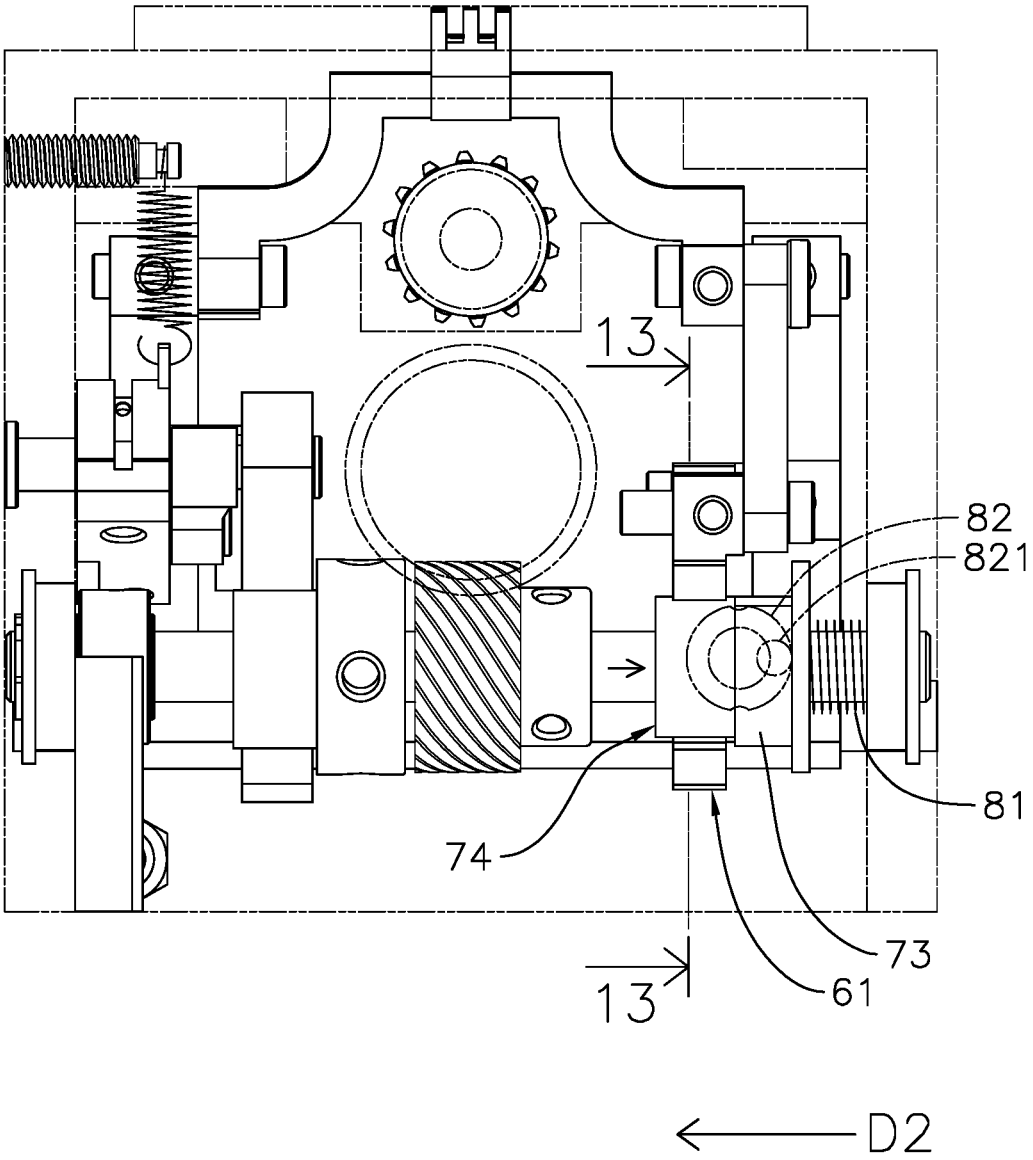
FIG. 11 is another front view of the feeding device in FIG. 1, showing the second crank detached from the second sliding recess of the second driven rack.

With reference to FIGS. 1, 8 and 9, if needle pitch changing or functions switching between fabric-feeding and fabric-reversing are required, turn the pitch-regulating disc 91 to change the angle of the second feeding-connecting rod 43. When the second feeding-connecting rod 43 is pivoted to a limit an angle along the fabric-feeding direction D1 (shown in FIG. 8), by switching a fabric-reversing rod 94 (shown in FIG. 1), the present invention can be switched to a fabric-reversing mode. At this time, a moving stroke of the feed dogs plate 31 reaches its maximum, which means a fabric-reversing pitch is at the max. When the second feeding-connecting rod 43 is gradually pivoted along the direction opposite to the fabric-feeding direction D1, the moving stroke of the feed dogs plate 31 is gradually reduced (which means the fabric-reversing pitch is reduced) till the moving stroke of the feed dogs plate 31 is reduced to zero. At this time, if keep turning the second feeding-connecting rod 43 along the direction opposite to the fabric-feeding direction D1, the present invention will be switched to a fabric-feeding mode, and a fabric-feeding pitch is gradually increased. When the second feeding-connecting rod 43 is pivoted to a limited angle along the direction opposite to the fabric-feeding direction D1 (shown in FIG. 9), the present invention is in the fabric-feeding mode and the fabric-feeding pitch is increased to its maximum.

Another advantage of the present invention compared to traditional techniques is that the present invention not only can process flat sewing but also can process embossing sewing. To be specific, by the second crank 73 formed at the switching sleeve 74 and being moveable axially, and by controlling a position of the switching sleeve 74 through the raising-controlling mechanism 80, the present invention can process flat sewing or embossing sewing according to needs.

To sum up, the driving shaft 71 has the first crank 72 and the second crank 73, when the driving shaft 71 is rotated, the first crank 72 drives the feed dogs plate 31 through the feeding-driven mechanism 40 and the terminal driven rack 30, making the feed dogs plate 31 generate mostly horizontal reciprocating motions. The second crank 73 drives the feed dogs plate 31 through the raising-driven mechanism 60 and the terminal driven rack 30, making the feed dogs plate 31 generate mostly up-and-down reciprocating motions. Therefore a volume of the feeding device is reduced, and elements of the feeding device are mostly put under the needle plate 93 of the sewing machine for easier maintenance.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the board general meaning of the terms in which the appended claims are expressed.

What is claimed is:

1. A feeding device of an industrial sewing machine, the feeding device comprising:

a shell base;

a main connecting rack pivotally connected to the shell base, and having a rotating axis;

a first bar portion;

a second bar portion, wherein the first bar portion and the second bar portion both extend along a radial direction of the rotating axis of the main connecting rack;

a terminal driven rack, one end of the terminal driven rack pivotally connected to an outer end of the first bar portion, and another end of the terminal driven rack pivotally connected to an outer end of the second bar portion; the terminal driven rack having a feed dogs plate;

a feeding-driven mechanism connected to the first bar portion of the main connecting rack and the shell base, and having a first driven rack having a first connecting end pivotally connected to the first bar portion of the main connecting rack; and a first recess end connected to the shell base, and having a first sliding recess;

a raising-driven mechanism connected to the second bar portion of the main connecting rack and the terminal driven rack, and having a second driven rack having a second connecting end pivotally connected to the second bar portion of the main connecting rack; and a second recess end having a second sliding recess;

a raising-connecting rod, one end of the raising-connecting rod pivotally connected to the second recess end of the second driven rack, and another end of the raising-connecting rod pivotally connected to the terminal driven rack; and a driving shaft rotatably mounted at the shell base, and having a first crank mounted through and abutting against the first sliding recess of the first driven rack of the feeding-driven mechanism; and a second crank mounted through and abutting against the second sliding recess of the second driven rack of the raising-driven mechanism.

2. The feeding device of an industrial sewing machine as claimed in claim 1, wherein the feeding-driven mechanism has a first feeding-connecting rod having a recess-connecting end pivotally connected to the first recess end of the first driven rack; and a first rod-connecting end;

a second feeding-connecting rod having a second rod-connecting end pivotally connected to the first rod-connecting end;

a base-connecting end pivotally connected to the shell base;

the first driven rack of the feeding-driven mechanism is connected to the shell base by the first feeding-connecting rod and the second feeding-connecting rod;

the feeding device has a feeding-controlling mechanism connected to the second feeding-connecting rod of the feeding-driven mechanism, and configured to drive an angle of the second feeding-connecting rod relative to the shell base.

3. The feeding device of an industrial sewing machine as claimed in claim 2, wherein the second feeding-connecting rod of the feeding-driven mechanism has a cable-connecting portion protruding from the base-connecting end;

the feeding-controlling mechanism has a cable connected to the cable-connecting portion of the second feeding-connecting rod, and configured to selectively drive the second feeding-connecting rod to pivot along a fabric-feeding direction, thereby changing the relating angle of the second feeding-connecting rod relative to the shell base;

a feeding-controlling resilient element configured to drive the second feeding-connecting rod to pivot along a direction opposite to the fabric-feeding direction.

4. The feeding device of an industrial sewing machine as claimed in claim 3, wherein the driving shaft has a switching sleeve mounted around the driving shaft, and being axially movable and non-rotatable relative to the driving shaft;

the second crank protrudes from an outer circumferential surface of the switching sleeve;

the feeding device has a raising-controlling mechanism configured to selectively move the switching sleeve along an axial direction of the driving shaft, thereby moving the second crank to detach from or mount through the second sliding recess.

5. The feeding device of an industrial sewing machine as claimed in claim 4, wherein the raising-controlling mechanism has a raising-controlling resilient element configured to drive the switching sleeve to move along a mounting direction, thereby moving the second crank to mount through the second sliding recess;

a raising-operating element pivotally or movably mounted at the shell base, and configured to selectively drive the switching sleeve to move along a direction opposite to the mounting direction, thereby moving the second crank to detach from the sliding recess.

6. The feeding device of an industrial sewing machine as claimed in claim 2, wherein the driving shaft has a switching sleeve mounted around the driving shaft, and being axially movable and non-rotatable relative to the driving shaft;

the second crank protrudes from an outer circumferential surface of the switching sleeve;

the feeding device has a raising-controlling mechanism configured to selectively move the switching sleeve along an axial direction of the driving shaft, thereby moving the second crank to detach from or mount through the second sliding recess.

7. The feeding device of an industrial sewing machine as claimed in claim 6, wherein the raising-controlling mechanism has a raising-controlling resilient element configured to drive the switching sleeve to move along a mounting direction, thereby moving the second crank to mount through the second sliding recess;

a raising-operating element pivotally or movably mounted at the shell base, and configured to selectively drive the switching sleeve to move along a direction opposite to the mounting direction, thereby moving the second crank to detach from the sliding recess.

8. The feeding device of an industrial sewing machine as claimed in claim 1, wherein the driving shaft has a switching sleeve mounted around the driving shaft, and being axially movable and non-rotatable relative to the driving shaft;

the second crank protrudes from an outer circumferential surface of the switching sleeve;

the feeding device has a raising-controlling mechanism configured to selectively move the switching sleeve along an axial direction of the driving shaft, thereby moving the second crank to detach from or mount through the second sliding recess.

9. The feeding device of an industrial sewing machine as claimed in claim 8, wherein the raising-controlling mechanism has a raising-controlling resilient element configured to drive the switching sleeve to move along a mounting direction, thereby moving the second crank to mount through the second sliding recess;

a raising-operating element pivotally or movably mounted at the shell base, and configured to selectively drive the switching sleeve to move along a direction opposite to the mounting direction, thereby moving the second crank to detach from the sliding recess.

* * * * *